United States Patent [19]

Kristoffersen

[11] Patent Number: 4,854,099

[45] Date of Patent: Aug. 8, 1989

[54] FLOOR STRUCTURE

[75] Inventor: Kaj Kristoffersen, Soro, Denmark

[73] Assignee: Junckers Industrier A/S, Koge, Denmark

[21] Appl. No.: 96,231

[22] Filed: Sep. 8, 1987

Related U.S. Application Data

[63] Continuation of Ser. No. 881,357, filed as PCT DK85/00097 on Oct. 21, 1985, published as W086/02686 on May 9, 1986, abandoned.

[30] Foreign Application Priority Data

Oct. 22, 1984 [DK] Denmark ..... 5032/84
Aug. 13, 1985 [DK] Denmark ..... 3673/85

[51] Int. Cl.[4] ..... E04F 15/14

[52] U.S. Cl. ..... 52/403; 52/480; 52/769

[58] Field of Search ..... 52/393, 403, 480, 769

[56] References Cited

U.S. PATENT DOCUMENTS 1,818,298 8/1931 Bowman ..... 52/393
2,405,235 8/1946 Randall ..... 52/403 X
2,743,487 5/1956 Kuhlman ..... 52/480 X
2,862,255 12/1958 Nelson ..... 52/403
3,090,082 5/1963 Baumann ..... 52/393

FOREIGN PATENT DOCUMENTS 1036493 8/1958 Fed. Rep. of Germany ..... 52/393

*Primary Examiner*—David A. Scherbel
*Assistant Examiner*—Creighton Smith
*Attorney, Agent, or Firm*—Pollock, Vande Sande & Priddy

[57] ABSTRACT

A floor structure comprises a flooring (10) situated on top of a first lower layer of joists (6) and a second upper layer of joists (8), said layers together forming a cross structure where the joists of the two layers extend perpendicular to one another. The two layers of joists are situated on top of chocking means (1). In order to obtain a good surface flexibility over the entire floor and consequently in order to make the floor structure suited as a sports floor, resilient spring elements (9) separating the two layers are situated at the intersections of the two layers of joists (6 and 8).

2 Claims, 1 Drawing Sheet

2
9
8
7
1
4
3
5

6
7
1
8

1
4
3
11
5
8
9
6
10

FLOOR STRUCTURE

This application is a continuation of application Ser. No. 881,357, filed as PCT DK85/00097 on Oct. 21, 1985, published as WO86/02686 on May 9, 1986, now abandoned.

FIELD OF THE INVENTION

The invention relates to a floor structure comprising a flooring situated on a first lower and a second upper layer of parallel and mutually spaced joists, wherein one layer extends substantially perpendicular to the joists of the other layer, and the first layer of joists is situated on chocking means arranged at regular intervals, said first layer furthermore being provided with a slot immediately above the chocking means.

BACKGROUND OF THE INVENTION

It is known to manufacture floor structures with a flooring of, for instance parquet and situated on two layers of parallel joists, wherein the joists of one layer extend perpendicular to the joists of the second layer, and wherein the two layers of joists abut one another directly and are situated on chocking means arranged at regular intervals. The joists abutting the chocking means directly are provided with a sawn vertical cut extending preferably into half thickness. Such a flooring does not, however, provide flexibility over a surface, i.e., so-called surface flexibility, which is sufficient for sports floor. The latter is especially due to the fact that the floor structure does not have sufficient flexibility on the sites were the joists of the two layers are intersecting. The cuts in the lower layer of joists damp the transmission of vertical oscillations in the flooring during use.

SUMMARY OF THE INVENTION

The new and characteristic feature of the floor structure according to the invention is that resilient spring elements separating the two layers are situated at the intersections between the two layers of joists.

In this manner a floor structure is obtained in a simple and inexpensive manner which over its entire surface has a flexibility allowing the floor to be used as a sports floor. At the same time it is possible to manufacture the flooring of solid wood, whereby the flooring is particularly resistant to the loads exerted thereon.

According to the invention it is particularly preferred that the resilient spring elements be substantially solid and made of rubber or plastic.

Furthermore, the second layer or joists may, according to the invention, be provided with a slot immediately above the spring elements, and the mutual distance and cross-sectional dimensions of the joists may be such that the following formula is met:

$$L_1E_1I_1=K.L_2E_2I_2,$$

where K is a structure constant varying between 0.1–1.5, but preferably between 0.55–0.65, and E is the elasticity module, L the distance between the joists, and I the moment of inertia, and where the symbol 1 refers to the upper layer of joists, and the symbol 2 to the lower layer of joists. In this manner, the flooring meets the requirements presented especially in some countries for the surface flexibility of sports floors, e.g., those applying in the Federal Republic of West Germany in the form of DIN 18032 part II.

BRIEF DESCRIPTION OF THE DRAWINGS

The invention will be described below with reference to the accompanying drawing, in which.

DESCRIPTION OF PREFERRED EMBODIMENT

Figure 1:
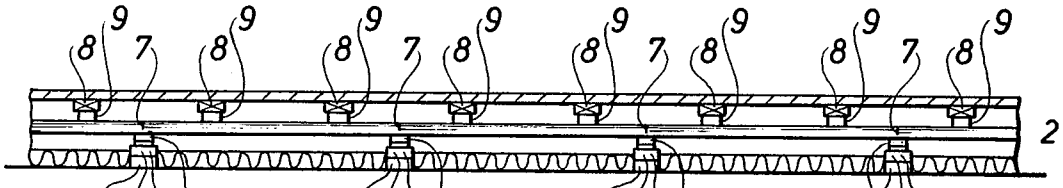
FIG. 1 is a vertical, longitudinal, sectional view through a floor structure according to the invention.
Figure 2:
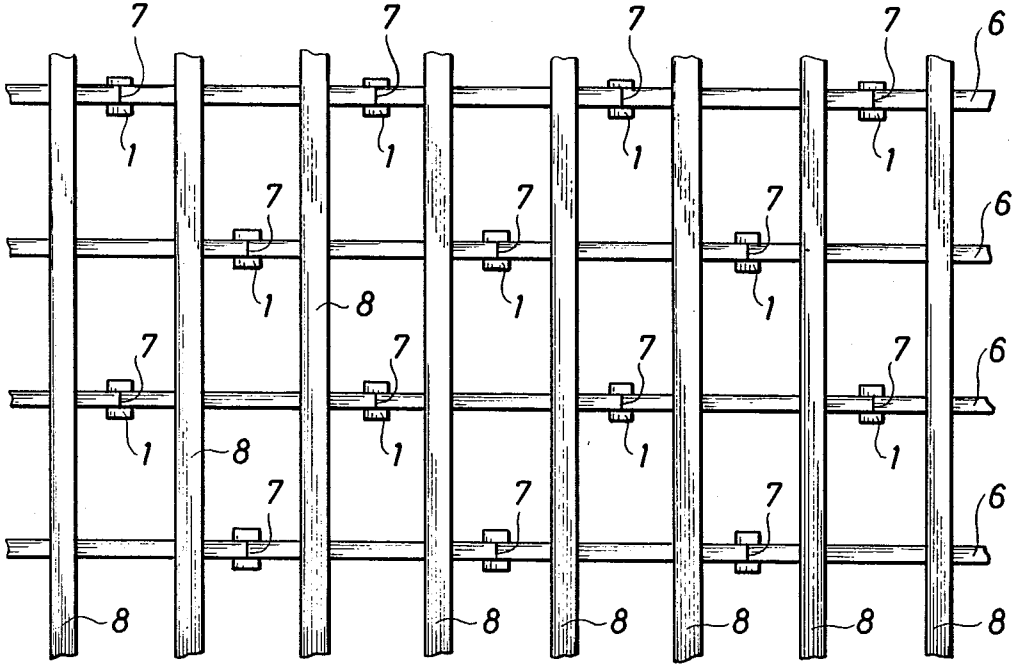
FIG. 2 is a top view of the structure of FIG. 1, whereby the flooring has been removed for the sake of clarity.
Figure 3:
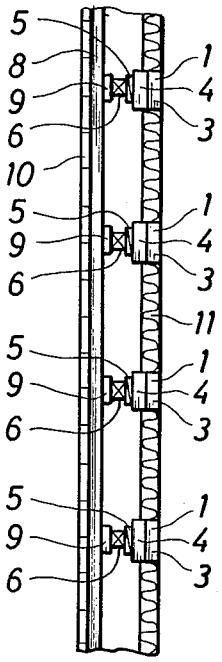
FIG. 3 is a vertical, traverse, sectional view through the floor structure of FIGS. 1 and 2.

The floor structure of FIGS. 1, 2, and 3 comprises rows of chocking means 1 situated on a foundation 2. These chocking means may, in a manner known per se, comprise one or more superposed wood blocks 3 and 4, wedging means 5 or another type of levelling means located on top of chocks. A first layer of parallel joists 6 is located on top of these chocking means 1, said joists being equidistant from one another and supported by the chocking means at sites also located at the same mutual distance. Immediately above the chocking means, the joists 6 are provided with a vertical cut 7 sawn down and extending from the top and downwards to half the thickness of the joists 6. A second layer of joists 8 is situated on top of the first layer of joists 6, said second layer of joists being parallel and equi-spaced, but also extending perpendicular to the joists 6 of the first layer. Small solid, resilient spring elements 9 are located everywhere between the two layers of joists 6 and 8, and immediately above these spring elements 9 the joists 8 have a vertical cut 12 sawn down and extending to a depth of $\frac{2}{3}$ of the thickness of the joists 8.

A flooring 10 of solid parquet is situated directly on the second layer of joists 8.

The joists 6 and 8 of the two layers of joists must be located at such a mutual distance and be dimensioned in such a manner that the dynamic resilience of the completed floor does not separate more than 15% from one another at the softest and the most rigid measuring site on the floor surface. In this manner, the floor structure meets the above-mentioned requirements presented in the Federal Republic of West Germany, and corresponding requirement in several other countries, in order to allow the floor structure to be used as a sports floor. These requirements are met provided $$L_1E_1I_1=K.L_2E_2I_2,$$

where K is a structure constant varying between 0.1–1.5, but preferably between 0.55–0.65, E is the elasticity module, L is the distance between the joists, and I is the moment of inertia. The symbols 1 and 2 refer to the second layer of joists 8 and the first layer of joists 6, respectively.

In the preferred floor structure the joists 8 of the second layer of joists have a cross-sectional dimentions 70×35 mm and the joists 6 of the first layer of joists the cross-sectional dimension 45×45 mm, whereas the spring element has the dimension 50×50×24 mm. The chocking means are made of joists of a width of 50 mm, and as their height may be so selected that, together with a wedging means 5, they allow horizontal levelling of the flooring of the floor structure.

As indicated in FIGS. 1 and 2, insulation 11 of a suitable type is located on top of a vapor blocking layer everywhere between the chocking means.

The dimensions and shape of the resilient spring elements can vary according to desire, as the abutment surface is preferably at least 50×50 mm and the thickness is preferably at least 17 mm. The elements may be profiled, i.e., they may, for instance, comprise grooves extending longitudinally. In order to facilitate the putting down procedure the spring elements may therefore be provided with a suitable profiling. The spring elements may be made of many different materials such as caoutchouc, neoprene rubber, nitrile rubber, polyvinyl chloride, ethylvinyl alcohol, polyurethane, polyacryl, polypropene, polystyrene or other similar materials or mixtures thereof. In the preferred embodiment, the spring elements are made of a rubber-like material sold under the Trade Mark "Regupol". The flooring is preferably made of solid, 22 mm thick press-dried beechwood parquet. Other floorings may, however, also be used, such as, for instance, 18–20 mm thick plywood, on which needle felt or a thin layer of plywood or another type of flooring material is located.

The spring elements may be secured on the adjacent joists in any suitable manner, such as by gluing or by nails.

If all the parts of the floor structure are made of wood, these parts should during the putting down of the floor have the following moisture contents: The joists 8: 12%, the joists 6: 12%, the wood chocks 3 and 4: 12%, and the parquet: 8%. In oerder to guarantee these moisture contents, the materials should be packed on a dampproof material until the time of application, and the moisture content should be maintained during the putting down of the floor. The spacing of the various parts of the preferred embodiment in the horizontal direction are as follows: The joists 6 of the first layer of joists: 41.1 cm, the joists 8 of the second layer of joists: 33.6 cm, and the chocking means 1: 67.3 cm, measured in the longitudinal direction of the joists 6.

What is claimed is:

1. A floor structure comprising a supporting floor (2) a flooring (10) located on top of a first, lower layer (6) and a second, upper layer (8) of parallel, spaced joists, the joists of one of said layers extending substantially perpendicularly to the joists of the other of said layers, and said first layer (6) being located on top of chocking means (1) in abutment with and permanently supported at regular intervals directly on a suporting floor, and resilient spring elements (9) separating the two layers of joists being positioned at intersections of said two layers of joists, said second layer of joists (8) also being provided with at least one transverse slot (12) immediately above said spring elements, and mutual distance and cross-sectional dimensions of said joists being such that the following formula applies:

$$L_1E_1K_1=K.L_2E_2I_2$$

where I is a structure constant varying between 0.1 and 1.5, but preferably between 0.55 and 0.65, E is the elasticity module, L is the distance between the joists, I is the moment of inertia, 1 refers to the upper layer of joists and 2 to the lower layer of joists.

2. A floor structure as claimed in claim 1, wherein said joists and chocking means are made of wood, said joists and chocking means during laying down of said flooring having a moisture content of about 12%, and said flooring is a solid parquet having a moisture content of about 8% during laying down.

* * * * *